US006431349B2

(12) United States Patent
Shepherd et al.

(10) Patent No.: US 6,431,349 B2
(45) Date of Patent: Aug. 13, 2002

(54) DEVICE FOR CARRYING AN ARTICLE

(76) Inventors: David Christian Shepherd; Kathleen Margaret Shepherd, both of Rosehaven, 490 Pilgrims Way, Wouldham, Rochester, Kent ME1 3 RB (GB)

( * ) Notice: Subject to any disclaimer, the term of this patent is extended or adjusted under 35 U.S.C. 154(b) by 0 days.

(21) Appl. No.: 09/784,184

(22) Filed: Feb. 16, 2001

(30) Foreign Application Priority Data

Feb. 18, 2000 (GB) ..... 0003664

(51) Int. Cl.[7] ..... B05C 17/00

(52) U.S. Cl. ..... 206/1.7; 53/397; 206/451; 206/560; 248/451; 294/138

(58) Field of Search ..... 206/1.7–1.9, 224, 206/449, 451, 452, 495, 521, 560, 565, 575, 707, 708, 722, 723, 756, 775; 211/44, 45, 125, 175, 207; 248/451–453; 269/9; 294/138, 172; 427/1; 53/397

(56) References Cited

U.S. PATENT DOCUMENTS 1,908,345 A * 5/1933 Hamer ..... 206/449
1,971,258 A * 8/1934 Hilliard ..... 206/565
2,570,439 A * 10/1951 Forca ..... 248/452
2,895,599 A * 7/1959 Moyer et al. ..... 206/1.7
4,081,119 A 3/1978 Messmore
4,471,869 A 9/1984 Hasenfus
6,048,570 A * 4/2000 Poole ..... 427/1
6,065,604 A * 5/2000 Storck ..... 206/560

FOREIGN PATENT DOCUMENTS

GB 2 293 367 3/1996

* cited by examiner

*Primary Examiner*—Jim Foster
(74) *Attorney, Agent, or Firm*—Larson & Taylor, PLC

(57) ABSTRACT

An article, such as an artist's canvas (12), having at least one touch sensitive area (14) on its surface is carried in a device (10) comprising a base (16), side walls (18, 19, 20, 21), and a cross-member (22) extending across the device (10) in a position spaced from the base (16). A plurality of contact pins (24) are carried by the cross-member (22) and extend towards the base (16). The location of the contact pins (24) on the cross-member (22) can be adjusted, thereby to enable the contact pins (24) to make contact with the article (12) at positions spaced from the touch sensitive area (14).

10 Claims, 1 Drawing Sheet

DEVICE FOR CARRYING AN ARTICLE

FIELD OF THE INVENTION

The present invention is directed to a device for carrying an article, particularly an article having touch sensitive areas on its surface. In a preferred embodiment the invention concerns a device for carrying an artist's canvas or board having areas of wet paint on its surface.

BACKGROUND TO THE INVENTION

The carrying of an article having touch sensitive areas on its surface, such as for example an artist's canvas or palette carrying wet paint areas, can be a problem. This is especially the case where the location of the touch sensitive area(s) is variable.

Many artists prefer to paint at a location remote from their home or studio, such as out of doors or at an art school. It is necessary for partially completed paintings and palette boards and fresh canvases to be transported to and from the remote location.

Devices for carrying artist's canvases are known. For example, U.S. Pat. No. 4,471,869 (Hasenfus) describes a carrying case for art canvases of various sizes which includes a horizontally and vertically adjustable supports for engaging the edges and the faces of the canvas.

However, it is often necessary to transport an incomplete picture, or at least with a canvas carrying areas of paint which are still wet. This is especially the case where slow-drying paints, such as oils are used. The device described by Hasenfus would be likely to cause damage to wet paint areas on the canvas and is unsuitable for use with non-rectangular articles such as palette boards. There is therefore a need for a device is which such canvas can be carried, without risk of damage to the wet paint areas.

SUMMARY OF THE INVENTION

According to the invention there is provided a device for carrying an article having at least one touch sensitive area on its surface, the device comprising a base, side walls, and a cross-member extending across the device in a position spaced from the base, a plurality of contact pins being carried by the cross-member extending towards the base and means being provided for adjusting the location of the contact pins on the cross-member, thereby to enable the contact pins to make contact with an article carried in the device at positions spaced from the touch sensitive area.

In use, the plurality of selectively positionable contact pins carried by the cross-member extend towards the base to contact the article at positions spaced from the touch sensitive area. In this way, the touch sensitive area is not damaged by contact, yet the article is securely held within the carrying device.

The touch sensitive area on the article being carried may be constituted by wet paint carried on a surface of the article. In particular the article may be an artist's canvas or an artist's paint palette, although in principle it is possible to use the carrying device for carrying any article having touch sensitive areas, for example models and sculptures, provided that the article includes at least one area capable of sustaining the retaining pressure of the contact pins without damage.

The cross-member may be removable, to enable access to the article in the carrying device. Alternatively, access to the article may be possible through one or more of the side walls of the carrying device.

Although a circular cross-section is possible, the carrying device preferably has a polygonal cross-section, in particular a rectangular cross-section, the cross-member being of such dimensions to enable the ends thereof to be located in corners formed by adjacent side walls. For example, the ends of the cross-member may be shaped to fit into diametrically opposite corners of the carrying device.

The cross-member may have a plurality of holes spaced at different locations, the contact pins being located in selected ones of the holes. Alternatively, the cross-member may be formed with one or more slots, the upper ends of the contact pins extending through the slots, being slidable along the slots and being lockable at desired locations.

The cross-member may have an elongate shape, although any shape is possible, even a shape which occupies substantially the whole cross-section of the carrying device, i.e. the cross-member may constitute a lid for the carrying device. However, it is preferred to provide a separate lid which, when in a closed position, presses against the cross-member. The lid may be hinged to one of the side walls of the carrying device. One advantage of providing a cross-member which is separate from a hinged lid is that, in the case of a removable cross-member, the contact pins are brought into contact with, and lifted away from, the canvas in a direction substantially perpendicular to the canvas surface. This is less liable to cause damage than in the case of contact pins carried on a hinged lid, which would be brought into contact with, and moved away from, the canvas along a somewhat tangential path.

As an alternative to dimensioning the cross-member such that it is retained in diametrically opposite corners of the carrying device, means may be provided to secure the cross-member to side walls of the carrying device, for example in other positions. For example, brackets may be provided at each end of the cross-member enabling the cross-member to be secured at a given location, or at one of a number of alternative locations, to the side walls of the carrying device.

The contact pins are preferably of variable effective length, enabling articles of different thicknesses to be carried in the carrying device. For example, the pins may carry a threaded portion which engages a threaded hole in the cross-member, whereby screwing the pin further through the hole enables the effective length of the pin to be varied. Alternatively, the pins may be telescopic and/or spring loaded. In one particular embodiment, instead of providing contact pins of variable effective length, a set of pins of different lengths are provided, the most appropriately sized pins being selected for use according to the thickness of the article, while the other pins remain unused, optionally being retained in a storage space within the carrying device.

Optionally, a spacer member may be provided for inserting between the cross-member and the lid when especially thin articles are being carried. Such a spacer member should preferably be releasably secured to either the cross-member or the lid, for example by the use of a releasable adhesive material such as Blu-Tack (Trade Mark).

BRIEF DESCRIPTION OF THE DRAWING

The invention will be described in further detail, purely by way of example, with reference to the accompanying drawings, in which.

DETAILED DESCRIPTION

Figure 1:
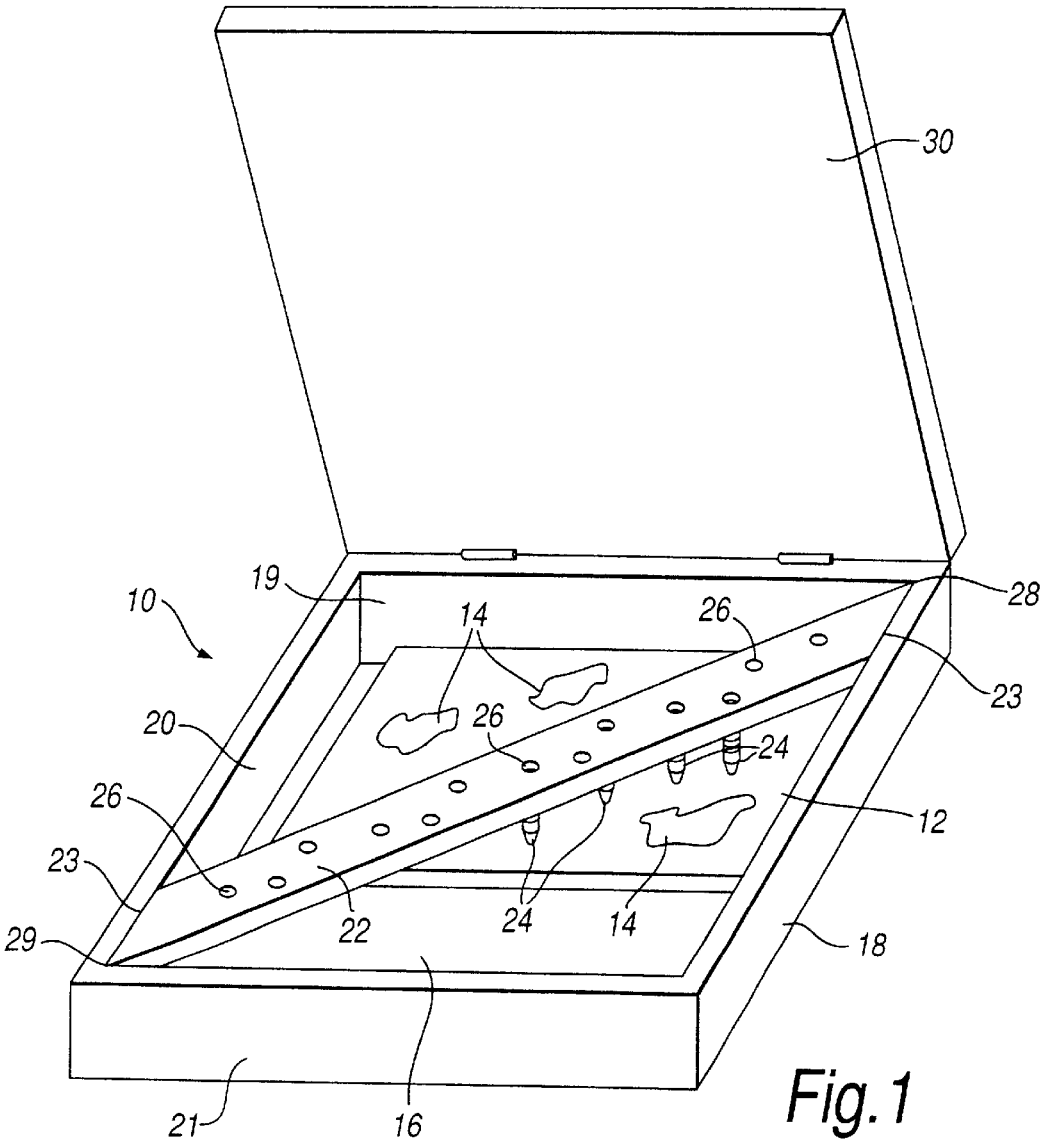
FIG. 1 shows an embodiment of a device according to the invention.

The device shown in the drawings is in the form of a box 10 carrying an artist's canvas 12 which has a number of areas 14 of wet paint on its surface.

The box 10, which is formed of wood or a plastics material, has a rectangular cross-section, comprising a base 16 and side walls 18, 19, 20, 21. A removable elongate cross-member 22, also formed of wood or a plastics material, extends across the box 10 from one corner 28 to the diametrically opposite corner 29 in a position spaced from the base 16.

A number of contact pins 24, formed for example of a relatively rigid metal or plastics material, are carried by the cross-member 22 and extend towards the base 16. The pins 24 are located in selected ones of a larger number of holes 26 provided in the cross-member 22, thereby to enable the location of the contact pins 24 along the cross-member 22 to be adjusted. It can thereby be ensured that the contact pins 24 make contact with the canvas 12 only at positions spaced from the wet paint areas 14.

The cross-member 22 has obliquely cut end faces 23, enabling its ends to be located in corners 28, 29 formed by adjacent side walls 18/19 and 20/21 respectively.

The box 10 further comprises a substantially airtight lid 30 which, when in a closed position, presses against the cross-member 22, to urge the pins 24 against the surface of the canvas 12.

Figure 2:
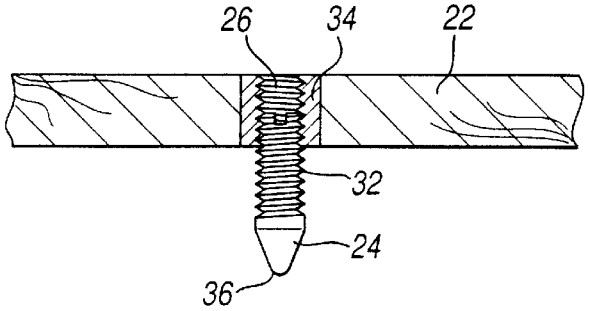
FIG. 2 shows the mounting of a contact pin in the cross-member of the device shown in FIG. 1.

As shown in FIG. 2, the pins 24 have an externally threaded portion 32 which engages in a correspondingly internally threaded relatively rigid bush 34 force-fitted into a hole 26 in the cross-member 22. By screwing the contact pin 24 further through the bush 34 the effective length thereof can be varied, enabling canvases of different thickness to be carried in the box 10. The tip 36 of the contact pin 24 is rounded off, i.e. it is a blunt tip, to reduce any possible damage to the canvas. However, the use of blunt tipped contact pins is not essential. The sharp tip of a contact pin may pass through the weave of the canvas material without causing significant damage, especially if, at the point of contact, the canvas is backed by a rigid frame. In this event, greater lateral stability can be achieved than may be possible with blunt tipped contact pins. For this reason, where the article being carried is a canvas secured to a frame, the positions of the contact pins are preferably so selected that they contact the canvas at the framed edges thereof, contrary to the arrangement shown in FIG. 1.

We claim:

1. A device for carrying an article having at least one touch sensitive area on its surface, the device comprising a base, side walls, and a cross-member extending across said device in a position spaced from said base, a plurality of contact pins being carried by said cross-member said contact pins having tips extending towards said base and means being provided for adjusting the location of said contact pins on said cross-member, thereby to enable said tips of said contact pins to make contact with an article carried in said device at positions spaced from said touch sensitive area.

2. The device according to claim 1, wherein said cross-member is removable.

3. The device according to claim 1, having a polygonal cross-section, said cross-member being of such dimensions to enable ends thereof to be located in corners formed by adjacent side walls.

4. The device according to claim 1, wherein said cross-member has a plurality of holes spaced at different locations, said contact pins being located in selected ones of said holes.

5. The device according to claim 1, wherein said cross-member has an elongate shape.

6. The device according to claim 1, further comprising a lid which, when in a closed position, presses against said cross-member.

7. The device according to claim 1, wherein said pins are of variable effective length, enabling articles of different thicknesses to be carried in said carrying device.

8. A method of carrying an article having at least one touch sensitive area on its surface, by use of a device comprising a base, side walls, and a cross-member extending across said device in a position spaced from said base, said article being located between said base and said cross-member, extending a plurality of selectively positionable contact pins from said cross-member towards said base to enable tips of said contact pins to contact said article at positions spaced from said touch sensitive area.

9. The method according to claim 8, wherein said touch sensitive area is constituted by wet paint carried on a surface of said article.

10. The method according to claim 9, wherein said article is an artist's canvas or an artist's paint palette.

* * * * *